United States Patent [19]

Beck et al.

[11] 4,030,983

[45] June 21, 1977

[54] METHOD OF RESTRICTING DUST DEVELOPMENT WHEN FEEDING COAL INTO COKE OVENS

[75] Inventors: Kurt Günther Beck; Wolfgang Rohde; Diethard Habermehl; Werner Siebert, all of Essen, Germany

[73] Assignees: Bergwerksverband GmbH; Didier Engineering GmbH, both of Essen, Germany

[22] Filed: Apr. 5, 1976

[21] Appl. No.: 673,895

Related U.S. Application Data

[63] Continuation-in-part of Ser. No. 646,751, Jan. 6, 1976.

[30] Foreign Application Priority Data

Apr. 4, 1975 Germany ..... 2514859

[52] U.S. Cl. ..... 201/23; 201/40

[51] Int. Cl.[2] ..... C10B 53/04; C10B 55/02

[58] Field of Search ..... 201/6, 9, 20, 21, 25, 201/28, 23, 40; 202/262, 263

[56] References Cited

UNITED STATES PATENTS

| | | | |
|---|---|---|---|
| 1,875,287 | 8/1932 | Weber | 201/20 X |
| 1,920,951 | 8/1933 | Ramsburg | 201/23 |
| 2,314,641 | 3/1943 | Wolf | 201/20 X |
| 2,378,420 | 6/1945 | Lohr et al. | 201/23 |
| 2,556,154 | 6/1951 | Kern | 201/20 X |
| 3,146,183 | 8/1964 | Reed et al. | 201/23 |
| 3,511,391 | 5/1970 | Tucker | 202/262 X |
| 3,637,464 | 1/1972 | Walsh et al. | 201/6 |
| 3,675,797 | 7/1972 | Pries | 202/263 X |
| 3,682,339 | 8/1972 | Knappstein | 202/262 X |
| 3,857,758 | 12/1974 | Mole | 202/263 X |

*Primary Examiner*—Joseph Scovronek
*Assistant Examiner*—Arnold Turk
*Attorney, Agent, or Firm*—Michael J. Striker

[57] ABSTRACT

Coal is preheated and contacted with 0.5 to 3 percent by weight of moist coal tar, preferably bituminous coal tar. The thus-treated coal is admitted into a coke oven through the ceiling of the latter. The coal is poured into the coke oven, rather than being blown in, and is permitted to descend into the coke oven under the influence of gravity. Preferably, the coal is poured into the coke oven through at least two or three openings in the ceiling thereof. The coal tar serves to bind finely divided coal particles to the coarser particles and, in this manner, the development of dust during the introduction of the coal into the coke oven is restricted and, concomitantly, the danger of ignition or explosion is reduced.

12 Claims, 1 Drawing Figure

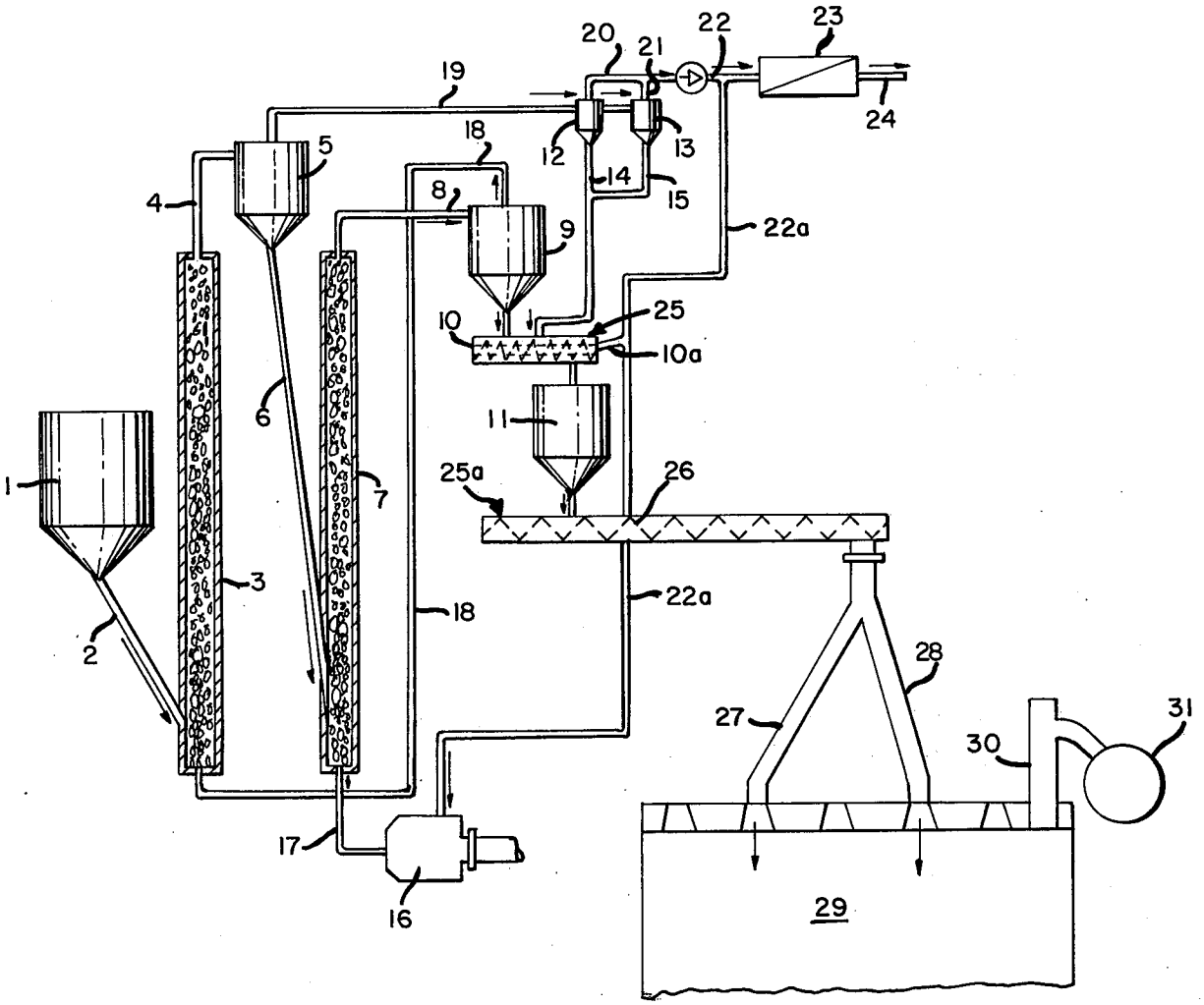
1
2
3
4
5
6
7
8
9
10
10a
11
12
13
14
15
16
17
18
19
20
21
22
22a
23
24
25
25a
26
27
28
29
30
31

METHOD OF RESTRICTING DUST DEVELOPMENT WHEN FEEDING COAL INTO COKE OVENS

CROSS-REFERENCE TO RELATED APPLICATION

This application is a continuation-in-part of the copending application Ser. No. 646,751 entitled "A Method of Restricting the Formation of Dust When Feeding Coal Into Coke Ovens" and filed Jan. 6, 1976.

BACKGROUND OF THE INVENTION

The invention relates generally to the coking of coal.

The coking of dry coal, that is, coal which has been preheated to temperatures of 150° to 250° C, for example, provides the advantage that savings in the heating costs associated with the production of coke may be realized. Thus, whereas the heating required for the coking operation is costly, it is possible to preheat the coal using relatively inexpensive heating means. Furthermore, the preheating of the coal permits coke of higher quality to be produced therefrom and, in particular, permits coke of larger particle size and greater abrasion resistance to be obtained than would be possible otherwise. As a result of this, it is possible to produce a relatively good quality of coke from coal having relatively poor coking characteristics by preheating the coal.

It is already known to pneumatically convey preheated coal from a supply container into the individual chambers of a coke oven battery via a branched conduit system. With this filling technique, ignitions and explosions occur in the oven chambers. The explanation for this resides in that the coal must be admitted into the oven chambers with a considerable amount of force, and accordingly, the blowing of the coal causes the hot coking coal to be admitted into the individual chambers in the form of streams so that part of the coal comes into contact with the hot atmospheres in the chambers, as well as with the hot chamber walls, in the form of a fine dust cloud. The above filling technique requires a strong blowing of the coking coal into the chambers in order to achieve a uniform filling of the coal over the entire lengths of the respective chambers. It is apparent that the filling technique just described has associated with it the disadvantage that there exists a particularly strong propensity for the development of dust and, concomitantly, an increased danger of explosion.

It has been proposed, in order to suppress the danger of ignition and explosion, to add between 0.5 and 5 percent by weight of residual oil, or residual oil in admixture with pitch, to the preheated coal. This proposal was intended to make it possible to pneumatically admit the hot coal into the coke oven chambers without danger. Evidently, this proposal contemplates for the fine dust particles to be agglomerated by means of the residual oil so that these dust particles become harmless as a cause of dust explosions. The reason for the selection of residual oil, in admixture with pitch if desired, from among the many known oils which are effective for binding dust is based on the fear that the addition of oils of lower boiling point to the coal might create an additional fire and explosion hazard rather than suppressing such hazard. With residual oil, in admixture with pitch if desired, such danger should be small since residual oil contains only small amounts of readily volatilizable constituents.

The addition to the coal of residual oil, in admixture with pitch if desired, does not, however, prevent substantial amounts of coal dust from being carried out of the oven chambers into the collecting means exteriorly thereof. Thus, as a rule, an additional formation of dust takes place in the upper regions of the oven chambers towards the end of the filling operation. The reason for this resides in that the gases which develop as a result of degasification rise through the coal charge in the chambers and, for a certain period of time, cause the coal to be in a fluidized state in the upper regions of the chambers. With the above-described method, the quantity of coal dust carried out of the chambers is between approximately 30 and 50 kilograms per ton of coal.

The coal dust which escapes from the oven chambers and enters the collecting means is referred to as "carry over" in the art. This coal dust forms a highly viscous mass in the collecting means which is difficult to remove. Moreover, a portion of the dust is carried into the tar separator by the condensate flowing out of the collecting means. In the tar separator, the dust leads to the formation of an emulsion during the separation of the tar and the water and, as a result, gives rise to difficulties in the tar separator.

SUMMARY OF THE INVENTION

One object of the invention is to provide a method which enables the development of dust, when feeding coal into coke ovens, to be restricted.

Another object of the invention is to provide a method which enables the quantity of dust carried over from the coke oven chambers to the collecting means to be greatly reduced from that observed heretofore.

These objects, as well as others which will become apparent hereinafter, are achieved in accordance with the invention. According to one aspect of the invention, there is provided a method of restricting the development of dust when feeding coal into a coke oven which comprises contacting the coal with coal tar. The thus-treated coal is admitted into the coke oven in such a manner that the coal descends into the coke oven by gravity.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE is a schematic representation of one form of arrangement which may be used for carrying out a method according to the invention.

DESCRIPTION OF THE PREFERRED EMBODIMENTS

It has now been found that a substantial reduction in the quantity of dust carried over from the coke oven chambers into the collecting means during the filling of coal into coke ovens may be achieved in that the coal is wetted with coal tar and the thus-treated coal is permitted to descend into the ovens by gravity.

A particularly advantageous embodiment of the invention contemplates feeding preheated coal into a coke oven. The preheated coal is contacted or wetted with about 0.5 to 3 percent by weight of bituminous coal tar and the thus-treated coal is introduced into the oven by pouring it through at least two or three filler caps or filler openings provided in the roof or ceiling of the oven.

The invention is based on the recognition that, when the coal is introduced into the coke oven by pouring, that is, when the coal is essentially permitted to slide into the coke oven under the influence of its own weight, no ignitions or explosions will occur if the hot coal, which is generally preheated to temperatures between about 150° and 250° C, is wetted with tar. The observation that this is so may be explained, on the one hand, in that essentially only tapered or conical piles of coal are formed in the oven chamber when using this filling technique. The coal gradually travels to the chamber walls along these piles and, by virtue of the gradual approach of the coal to the chamber walls, a spontaneous or abrupt heating of the coal particles impinging the chamber walls does not occur. On the other hand, the degree to which dust clouds form is in any event less than that when using pneumatic filling techniques where large dust clouds are artificially formed by the gas used to transport the coal and where the formation of dust clouds is substantial despite the addition of residual oil or pitch.

As mentioned above, the coal is advantageously introduced into the coke oven by pouring it through at least two or three filler caps or filler openings provided in the roof or ceiling of the oven. The reason why it is of advantage to admit the coal through at least two or three openings resides in that it might not otherwise be possible to obtain a reasonably uniform filling of the coke oven with coal. In the prior art, where the coal is provided with an impetus by the gas used to pneumatically convey the coal into the coke oven, this consideration is not of particular consequence.

The result achieved in accordance with the invention is particularly surprising since it would be assumed that tar, which has a relatively substantial proportion of low boiling point hydrocarbons, would sooner be capable of leading to explosions than tar.

Tar has the advantage that it distributes itself over the coal particularly rapidly and uniformly. This is probably due to the close relationship between tar and coal and, for a preferred embodiment of the invention, between bituminous coal tar and bituminous coal, and also to the proportion of low boiling point substances contained in the tar. It is apparent that tar is more strongly and more rapidly adsorbed by the coal than is residual oil. On the basis of this, and on the basis of the filling technique selected by the invention, it becomes clear that the carry over when using the invention lies well beneath that observed when using the prior art methods.

It is possible to utilize a special mixing device for the purpose of wetting the coal with the coal tar, preferably bituminous coal tar, but this is unnecesary.

The good wetting ability of the coal tar is not affected by water. In this connection, it may be mentioned that it is particularly advantageous to use coal tar which has been derived from the same type of coal as that being fed into the coke oven and which is contacted with the coal tar. Such coal tar may be obtained from the collecting means located exteriorly of the coking chamber. The coal tar generated in the collecting means is usually subjected to a water rinse by the water admitted into the collecting means and is thereafter usually conveyed through a tar separator for the purpose of recovering the same for use in wetting the coal. Although, as a rule, water from the water rinse adheres to the crude tar subsequent to its removal from the collecting means, and also subsequent to its recovery from the tar separator, this water does not affect the good wetting ability of the coal tar.

The water content of the tars contemplated by the invention is generally between about 3 and 7 percent by weight. It has been found that it is precisely this water content which, in itself, is relatively low, that significantly enhances the distribution of the crude tar over the coal. Presumably, the water content of the tar acts as a wetting agent between the crude tar and the preheated coal.

This effect, that is, a wetting agent effect, may be enhanced by adding surfactants, which are themselves known, to the water-containing tar. The surfactants contemplated by the invention are, for the most part, relatively highly soluble in water and are more effective in water than in organic media. Water-containing crude tar combined with such surfactants thus provides a particularly effective additive for the binding of dust to the hot coal. The surfactants may be combined with the tar in quantities of up to about 1 percent by weight. Exemplary of the surfactants which may be used are the known sodium and potassium soaps, sulfonates of fatty alcohols and fatty alcohol-polyoxyethylene products.

It is advantageous to spray the crude tar onto the preheated coal immediately after termination of the preheating operation and before the introduction of the preheated coal into the transporting device which conveys the coal to the coke oven. In this manner, there is achieved, as a favorable side effect, the result that the transporting devices are provided with a certain amount of lubrication and thus operate more silently. Heretofore, transporting devices such as, for instance, chain conveyors, emitted very loud and bothersome sounds. It will be understood that, aside from the reduction in noise level achieved by virtue of the lubricating effect, the wear to which the transporting devices are subjected is reduced.

The coal may be preheated by forming a fluidized bed to the coal. When the coal is heated in a fluidized bed, a portion of the finely divided coal is carried away by the gaseous medium which is used for the fluidization and which may also serve as a heating agent. This portion of the coal may be recovered from the fluidizing medium in one or more cyclones. It is particularly advantageous, as regards the effectiveness of the tar addition, for the total requisite quantity of tar to be mixed only with the finely divided coal recovered from the cyclone or cyclones and to then combine the thus-wetted finely divided coal with the remainder or bulk of the preheated coal.

It is to be understood, however, that it is possible to add the tar to the preheated coal at plural locations of the path along which the coal is transported to the coke oven, that is, it is possible to add a portion of the total requisite quantity of tar to the preheated coat at each of a plurality of locations of the path along which the coal is transported.

As mentioned previously, the coal tar distributes itself over the heated coal with substantially greater rapidity and uniformity than residual oil, and this is especially so when the coal tar has been derived from the same type of coal as that being coked, e.g., bituminous coal tar when coking bituminous coal. Presumably, this difference between coal tar and residual oil is due to a certain structural relationship between the coal and the tar derived therefrom as well as a broader boiling progression for the tar. The structure of a particular type of coal such as, for instance, bituminous coal, varies considerably from mine to mine, however. Therefore, it is understandable that the best results with respect to a rapid and homogeneous wetting are obtained with that tar which is derived from the same sort of coal as that to be contacted or sprayed with the tar, that is, the best results are obtained with tar derived from coal coming from the same source as that to be contacted with the tar. Accordingly, it is advantageous to always use the tar generated in the apparatus in which the preheated coal is coked.

The invention will now be further described with reference to the single FIGURE.

Coking coal which, in general, has a particle size of 0.06 to 6 millimeters, is obtained from a supply container 1. From the container 1, the coal is fed into the bottom of a first pneumatic conveying dryer via a conduit 2. The coal travels upwardly through the drying 3 and, concomitantly, is subjected to a first dryer and preheating stage.

The coal leaves the dryer 3 through a conduit 4 and, from the latter, is introduced into a cyclone 5 where it is removed from the gas which entrained it and carried it through the dryer 3. From the cyclone 5, the coal slides to the bottom of a second pneumatic conveying dryer 7 via a conduit 6. The coal travels upwardly through the dryer 7 and, simultaneously, is subjected to a second drying and preheating stage.

The coal leaves the dryer 7 through the top thereof and enters a conduit 8 from which it is introduced into a cyclone 9. In the cyclone 9, the coal is removed from the gas which entrained it and carried it through the dryer 7. From the cyclone 9, the coal is forwarded to a storage and feed container 11 via a screw conveyor 10.

The gases in the cyclone 5 containing the fine portions of the coal are withdrawn from the cyclone 5 via a conduit 19. The thus-withdrawn combustion gases are then admitted into cyclones 12 and 13 wherein they are freed from the fine portions of the coal, that is, the coal dust. The thus-recovered fine coal is forwarded to the screw conveyor 10 through conduits 14 and 15.

The heating and conveying of the coking coal is effected with gases obtained from a combustion chamber 16. The hot gases produced therein, for instance, by the combustion of oil, initially flow through a conduit 17 into the dryer 7. After passing through the dryer 7, the hot combustion gases then pass through the conduit 8 into the cyclone 9 together with the coal which has been preheated in the dryer 7. From the cyclone 9, the hot combustion gases flow through a conduit 18 into the dryer 3.

In the dryer 3, the hot combustion gases convey the initially moist coal to and through the conduit 4 and into the cyclone 5. From the cyclone 5, the hot gases flow through the conduit 19 into the cyclones 12 and 13 mentioned earlier. The hot gases leave the cyclones 12 and 13 via conduits 20 and 21 and thereafter are conveyed into a conduit 22. The conduit 22 opens into a wet washer 23 and a desired portion of the hot gases flowing through the conduit 22 may enter the washer 23. The gases entering the washer 23 leave the apparatus as purified gases via a conduit 24.

A conduit **22*a* branches off from the conduit 22 and leads to the combustion chamber 16 and all or a portion, as desired, of the hot, water-containing gases flowing through the conduit 22 may be branched off through the conduit 22*a*. The hot gases flowing through the conduit 22 contain water since they have been used for drying of the initially moist coal. The hot, water-containing gases (vapors) withdrawn from the conduit 22 via the conduit 22*a* are returned to the combustion chamber 16**.

Prior to entry of the coal into the storage and feed container 11, the preheated coal is sprayed with crude tar at the locations indicated by the arrows marked 25. Particularly favorably, the preheated coal is sprayed with crude tar in the screw conveyor 10 at or adjacent the inlet provided for the coal. The gases released may escape from the screw conveyor 10 into the vapor line **22*a* via a conduit 10*a***.

When the coal stored in the container 11 is to be coked, the coal slides out of the container 11 into a chain conveyor 26. The conveyor 26 conveys the coal to conduits 27 and 28 through which the coal is fed into a coke oven 29. It is possible to spray crude tar into the conveyor 26 also as indicated by the arrow **25*a***.

An uptake 30 is connected to the coke oven 29. The reference numeral 31 identifies a collecting means in which the respective carry over is determined.

The following Example is intended to further illustrate the invention and is not to be considered as limiting the same in any manner:

EXAMPLE

A mixture of bituminous coals obtained from the Alpheus and Corbin mines of the United States has a volatile components content of 28 percent. The coal is heated to 190° C by pneumatic conveying techniques and is then charged into an enclosed mixing screw or conveyor. Upon entering the screw or conveyor, the coal is sprayed with 2 percent by weight of bituminous coal tar (containing 4 percent by weight of water) which has previously been heated to 70° C. The sprayed coal leaves the conveyor or screw and enters an intermediate or feed container. From the container, the sprayed coal travels onto a chain conveyor having a length of 70 meters. The conveyor opens into a charging hopper. From the hopper, the sprayed coal is permitted to slide into a coke oven chamber via conduits which are connected to the filling holes of the oven chamber. After the filling operation, the carry over is determined in the collecting means. The carry over is found to be 6 to 8 kilograms of coal dust per ton of coal charged or poured into the coke oven chamber.

If, instead of bituminous coal tar, the coal is admixed with a mixture of residual oils and pitch having a temperature of 70° C, the carry over amounts to about 12 kilograms of coal dust per ton of coal poured into the coke oven chamber. If, further, the thus-treated coal is pneumatically conveyed into the oven, rather than being poured in, a carry over of more than 15 kilograms of coal dust per ton of coal charged is observed.

It will be understood that each of the elements described above, or two or more together, may also find a useful application in other types of operations differing from the types described above.

While the invention has been illustrated and described as embodied in a method of restricting dust development when feeding preheated coal into coke ovens, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A process for producing coke from preheated coal whereby the amount of coal dust and the risk of explosion are reduced, comprising preheating the coal to a temperature between about 150° and 250° C, thereafter mixing the coal with about 0.5 to 3% by weight of moist coal tar and then gravity-pouring the thus-treated coal into the coke oven.

2. A method as defined in claim 1, wherein the coal tar contains about 3 to 7 percent by weight of water.

3. A method as defined in claim 1, wherein up to about 1 percent by weight of surfactant is added to the coal tar.

4. A method as defined in claim 1, wherein the coal tar is derived from the same type of coal as that mixed with the coal tar.

5. The process of claim 1 wherein the coal tar is sprayed onto the preheated coal.

6. The process of claim 1 wherein the pouring of the treated coal is effected through a multiplicity of openings in the ceiling of the coke oven.

7. The process of claim 1 wherein the coal is bituminous coal and the coal tar is bituminous coal tar.

8. The process of claim 1 wherein the tar is mixed with the coal immediately after termination of the preheating step.

9. The process of claim 1 wherein the coal is subjected to two successive drying and preheating stages prior to mixing the coal tar therewith.

10. The process of claim 1 wherein at least part of the coal tar is sprayed onto the preheated coal while the coal is moved to an intermediate supply vessel followed by moving the coal from the supply vessel to chutes for pouring into the coke oven.

11. The process of claim 1 wherein the coal is preheated and fluidized by a gaseous medium, followed by withdrawing the gaseous medium from the bulk of the coal, separating the entrained coal fines from the hot gaseous medium, thereafter mixing all or part of the coal tar with said coal fines and then uniting the tar-wetted fines with the bulk of the coal prior to gravity-pouring it into the coke oven.

12. The process of claim 11 wherein the hot gaseous medium separated from the coal fines in recycled for use in the preheating of the coal.

* * * * *